US006264798B1

(12) United States Patent
Gibson et al.

(10) Patent No.: US 6,264,798 B1
(45) Date of Patent: Jul. 24, 2001

(54) DELAYED COKER CHARGE HEATER AND PROCESS

(75) Inventors: William C. Gibson, Tulsa; Robert L. Gibson, Broken Arrow; James T. Eischen, Tulsa, all of OK (US)

(73) Assignee: Petro-Chem Development Co. Inc., New York, NY (US)

( * ) Notice: Subject to any disclaimer, the term of this patent is extended or adjusted under 35 U.S.C. 154(b) by 0 days.

(21) Appl. No.: 09/357,544

(22) Filed: Jul. 20, 1999

(51) Int. Cl.[7] ..... C10B 17/00; C10B 1/04; F22B 21/24

(52) U.S. Cl. ..... 202/124; 202/127; 196/117; 122/174; 122/235.14; 122/236; 122/356

(58) Field of Search ..... 208/132, 131, 208/50; 122/355, 511, 208, 235.14, 236, 174, 356; 202/124, 127; 196/117

(56) References Cited

U.S. PATENT DOCUMENTS 4,002,149 * 1/1977 Yamamoto et al. ..... 122/356
5,078,857 1/1992 Melton ..... 208/132
5,284,438 * 2/1994 McGill et al. ..... 431/9
5,656,150 * 8/1997 Reed et al. ..... 208/48 R
6,095,097 * 8/2000 Gibson et al. ..... 122/367.1

* cited by examiner

*Primary Examiner*—Bekir L. Yildirim
(74) *Attorney, Agent, or Firm*—Head, Johnson & Kachigian

(57) ABSTRACT

An improved process and article of manufacture to advance heater performance and reduce the cost of delayed coker charge heaters. Such improved performance is realized by routing delayed coker feedstock through a double row, double fired, heating conduit thus creating a channel to contain previously heated flue gas and resulting in the introduction of downflow, backside convective heat transfer to the interior portion of the heating conduit. When replacing the present art's single row coker tubes with the double row heating conduit afforded by the instant invention, the backside convective heat transfer introduced to the interior portion of the heating conduit eliminates the necessity of double firing the present art's single row coker heater tubes to achieve similar results.

13 Claims, 4 Drawing Sheets

DELAYED COKER CHARGE HEATER AND PROCESS

REFERENCE TO PENDING APPLICATIONS

This application is not related to any pending applications.

REFERENCE TO MICROFICHE APPENDIX

This application is not referenced in any microfiche appendix.

TECHNICAL FIELD OF THE INVENTION

In general, the present invention is directed to crude oil refining. In particular, the present invention is directed to a process and article of manufacture to advance the performance and cost effectiveness of a delayed coker charge heater, by introducing convective heat transfer to the interior portion of a double row, double fired, heating conduit intended to heat coker feedstock prior to transporting said feedstock to a coke drum.

BACKGROUND OF THE INVENTION

The present invention can be best understood and appreciated by undertaking a brief review of the crude oil distillation process, and most particularly, the cost redemptive role delayed coking plays within that process.

In its unrefined state, crude oil is of little use. In essence, crude oil (a.k.a. hydrocarbon) is a complex chemical compound consisting of numerous elements and impurities. Such impurities include, but are not limited to sulfur, oxygen, nitrogen and various metals that must be removed during the refining process.

Refining is the separation and reformation of a complex chemical compound into desired hydrocarbon products. Such product separation is possible as each of the hundreds of hydrocarbons comprising crude oil possess an individual boiling point. During refining, or distillation, crude oil feedstock temperature is raised to a point where boiling begins (a.k.a. "initial boiling point, or "IBP") and continues as the temperature is increased. As the boiling temperature increases, the butane and lighter fraction of crude oil are first distilled. Such distillation begins at IBP and terminates slightly below 100° F. The fractions boiling through this range are represented and referred to as the "butanes and lighter cut."

The next fraction, or cut, begins slightly under 100° F. and terminates at approximately 220° F. This fraction is represented and referred to as straight run gasoline. Then, beginning at 220° F. and continuing to about 320° F. the Naphtha cut occurs, and is followed by the kerosene and gas/oil cuts, occurring between 320° F. and 400° F., and 450° F. to 800° F., respectfully. A term-of-art "residue cut" includes everything boiling above 800° F.

The residue cut possesses comparatively large volumes of heavy materials and two fundamental processes are employed to convert appreciable amounts of such residuals to lighter materials—thermal cracking and delayed coking. While thermal-cracking may be properly considered "the use of heat to split heavy hydrocarbon into its lighter constituent components," delayed coking should be considered "severe thermal cracking" and occurs within a coke drum after a coker feedstock has been heated in an apparatus referred to as a coking heater, or "delayed coker charge heater." An improved delayed coker charge heater and process serve as the focus of the instant invention.

Delayed coking processes and heaters are well known in the art and have been discussed and disclosed, for example, in U.S. Pat. No. 5,078,857, invented by M. Shannon Melton and issued Jan. 7, 1992 (hereafter referred to as "Melton"). Melton and prior art references cited therein are hereby provided to disclose and distinguish said art from the novel improvements embodied and afforded by the instant invention.

Delayed coker charge heaters as represented by the present art employ, at best, a double fired, single row of feedstock encapsulating tubes which are heated in a "radiant" heat section of a delayed coker charge heater to a pre-defined temperature. Such single row, double fire technology fails to create any measurable convective heat transfer to the coke feedstock while the feedstock resides within the heater's radiant heating section. While radiant heat may be properly viewed as "heat transferred by the emission of waves from a fixed point or surface", convective heat is to be considered as "heat transferred via the circulatory motion that occurs in a fluid at a nonuniform temperature owing to the variation of its density and the action of gravity." Failure to introduce and contain significant quantities of flue gas for convective heat transfer within the "radiant heat section(s)" of today's double fired delayed coker charge heaters represents a present art design deficiency. A deficiency manifested in the present art, and remedied by the present invention.

Succinctly stated, as the temperature of flue gas decreases from flame temperature to exit temperature within the radiant heat section of a delayed coker charge heater, the present art fails to provide boundaries, or a channel, within which flue gas may be re-circulated to create convective heat transfer and improve radiant efficiency. Prior art reference, FIG. 1, is included herewith to illustrate a typical double fired coker heater configuration as represented by the present art. Similar configurations may be examined when reviewing Melton and relevant art cited therein.

In the present invention, a double row heating conduit creates a channel between the two interior boundaries of the conduit. This channel provides for significant backside convective heat transfer to the conduit as the cooled flue gas flows downwardly, within the channel toward the bottom of the radiant heat section of the delayed coker charge heater. Absent such backside convective heat transfer the double row, double fired heating conduit (synonymously referred to as "coil") would require 1.5/1.2 or 25% more surface area to create an equivalent average radiant flux rate to that realized when employing a single row, double fired coil. With backside convective heat transfer, however, the afore-stated ratio is reduced to 1.275/1.2, or only a 6.25% increase in radiant surface area. In reality, when the circumferential conductive heat transfer in the tube wall is taken into account, the difference is reduced to essentially 0 and the same number of tubes and surface area can be used.

In addition to advancing convective heat transfer, the double row, double fired heating conduit provides for substantial savings in coker construction materials. As an example, for thirty four-inch nominal tubes in a single row configuration, on eight-inch centers, the coil height would be nineteen feet four inches. For thirty four-inch nominal tubes in a double row configuration on twelve-inch triangular centers, the coil height is fourteen feet six inches. When utilizing a double row configuration, the net savings in firebox height equals four feet ten inches. Thus, the double row configuration results in significant savings in steel, refractory and other materials of construction.

The afore-stated convective heat transfer to the coil actually improves the radiant efficiency. As flue gas circulation rates are greatly increase in the radiant sections a more uniform vertical heat flux profile is created, thus reducing the temperature of the flue gas exiting the coker heater's radiant section and increasing radiant section thermal efficiency.

Hence, given the deficiencies of the present art and improvements afforded by the instant invention, what is needed is an improved process and article of manufacture to advance the performance of delayed coker charge heaters by introducing convective heat transfer to the interior portion of a double row, double fired, heating conduit transporting coker feedstock within the radiant heat section of said heaters.

BRIEF SUMMARY OF THE INVENTION

The present invention provides for an improved method and article of manufacture for greatly improving upon delayed coker heating processes and apparatuses represented in the presented art. Such improvement is afforded by taking advantage of convective heat transfer realized by placing a double row heating conduit in a coker heater's radiant heating section. Such placement and double-row configuration creates a channel to contain downflow (cooling) flue gas and introduces backside convective heat transfer to the interior portion of the heating conduit. Consequently, it is an objective of the instant invention to provide for material cost savings and an improvement in coker heater radiant thermal efficiency. Cost savings are the result of a great reduction in combustion chamber height. Radiant efficiency increases are realized as a result of increasing the recirculation rate of radiant section flue gas which creates uniform flux, thus improving efficiency. Quite distinguishable from the present art, the present invention incorporates both convection and radiation on the backside of the double row, double fired, heating conduit to effect its coking process.

Other objects and further scope of the applicability of the present invention will become apparent from the detailed description to follow, taken in conjunction with the accompanying drawings wherein like parts are designated by like reference numerals.

DETAILED DESCRIPTION OF THE PREFERRED EMBODIMENT

While the making and using of various embodiments of the present invention are discussed in detail below, it should be appreciated that the present invention provides for inventive concepts capable of being embodied in a variety of specific contexts. The specific embodiments discussed herein are merely illustrative of specific manners in which to make and use the invention and are not to be interpreted as limiting the scope of the instant invention.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is clear that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

Figure 1:
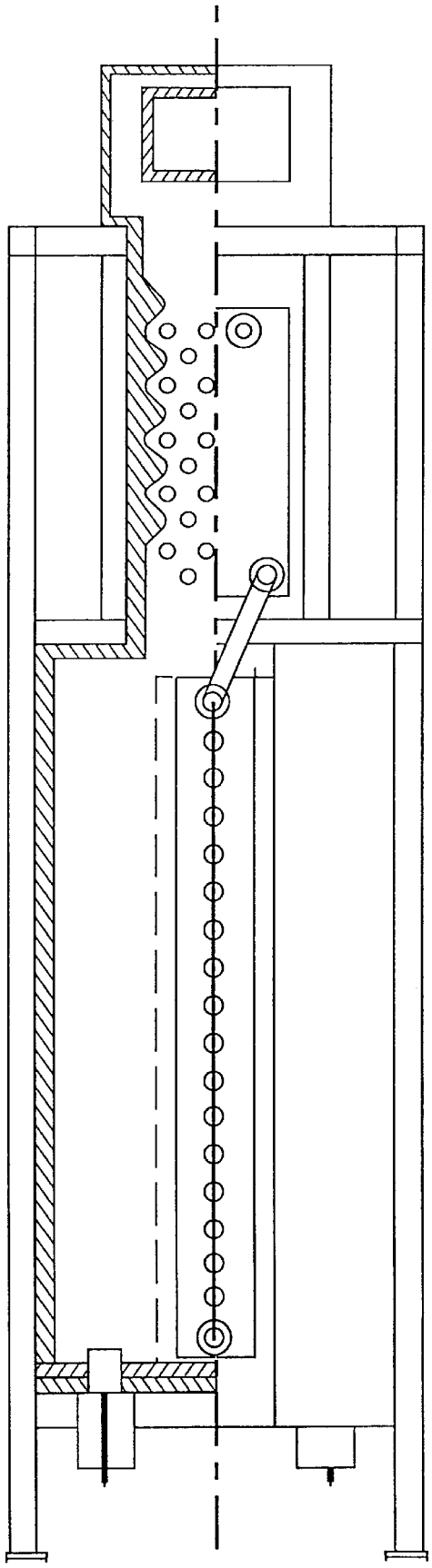
FIG. 1 PRIOR ART
FIG. 1 is a prior art illustration depicting a typical single row coker heater as represented by the present art.
Figure 2:
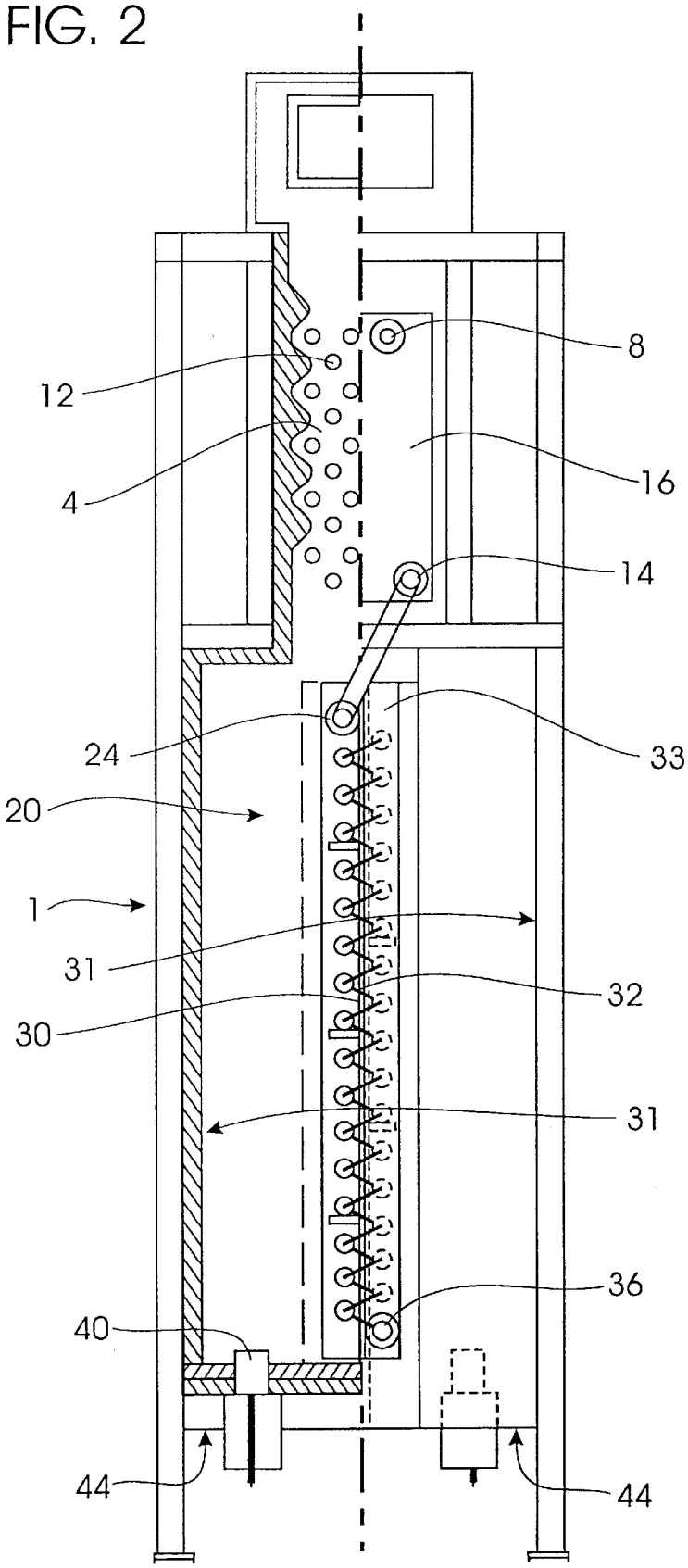
FIG. 2 is an illustration of the invention's preferred embodiment and the positioning the double row heating conduit within a coker's radiant heat section.

Referring to the drawings in detail, FIG. 2 illustrates the preferred embodiment for the invention's improved delayed coker charge heater 1. The delayed coker charge heater 1 is comprised of two heating sections, a first heating section 4 to introduce convection heat to the coker feedstock as it enters the coker heater 1 by way of a containment vehicle, typically a heat resistant metallic tube 12 and a second heating section 20, which further heats such feedstock by radiant heating means.

At system startup, the delayed coker charge heater's burners 40 are engaged and the heater 1 is warmed to an appropriate operating temperature to allow for the introduction of a process fluid, often referred to as coker heater feedstock. Said feedstock, typically recovered from a previous vacuum tower distillation process, then enters the delayed coker charge heater 1 by way of a first heating section inlet 8, and descends via containment tubes 12 throughout the first heating section 4 in a zigzag manner, in a direction counter to the normal "bottom-up" flow of flue gas occurring within said first heating section 4. The coker feedstock next exits the first heating section 4 by way of a first heating section outlet 14 located in the generally lower portion of the heating section 4. The first heating section 4 additionally provides for an insulated, removable cover 16 to facilitate containment tube 12 inspection and maintenance.

Having traversed the delayed coker charge heater's first heating section 4, the coker feedstock next enters into the heater's second heating section 20. Entry into the heater's second heating section is facilitated by a second heating section inlet 24 which connects to the uppermost portion of the double row heating conduit 32. In the preferred embodiment, the coker feedstock then descends, via the double row heating unit 32, through the second heating section 20 exiting through an outlet 36 located in the generally lower portion the bottom of the second heating section 20.

As the coke feedstock descends through the second heating section 20, heat introduced by the coker burners 40 cause flue gas to rise to the top of the second heating section 20 and into the first heating section 4. In the preferred embodiment, the coker burners 40 are located in a generally lower portion of the coker heater's second heating section 20, in close proximity to the coker unit's base 44. In an alternative embodiment, said burners 40 may be installed in one or more locations within the coker heater's second heating section 20, in proximity to, or distanced from said coker unit base 44. Such alternative placement of said burners 40, includes, but is not limited to, affixation of said burners 40 to the coker heater's second heating section sidewalls 31 or end walls. Said end walls defined and described herein as those walls generally perpendicularly abutting said sidewalls 31.

Figure 3:
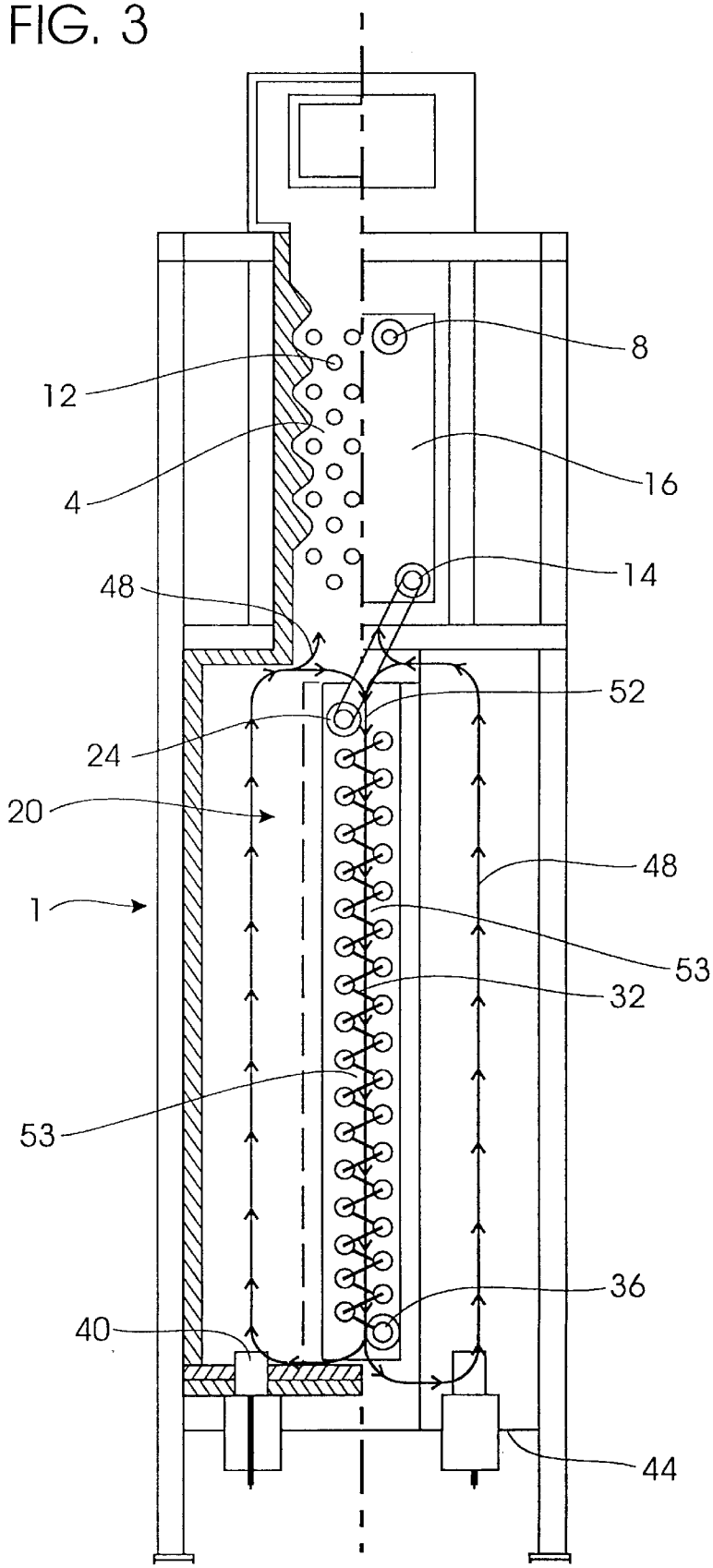
FIG. 3 is a is an illustration showing the channeling effect upon cooling flue gas as influenced by the invention's preferred embodiment.

As will be disclosed in association with FIG. 3, the present invention's novel utilization and placement of a double row heating conduit 32 allows such flue gases to not only rise and enter the first heating section 4, but as these flue gases cool, allows such gases to downflow in a channeled manner through the interior portion of the double row heating conduit 32. The invention's preferred embodiment use of a double row heating conduit 32 to transport coker feedstock and channel downflow flue gas through the interior portion of the conduit 32 is not to be construed as a limiting embodiment. As will be readily appreciated by those skilled in the art, such downflow flue gas channeling may be facilitated by placing two single row conduits in close proximity to one another to induce an equivalent channeling effect between the interior portions of the single row conduits. A detailed description and illustration of the channeled flue gas downflow through the interior portion of the double row heating conduit 32 is illustrated in FIG. 3.

Figure 4:
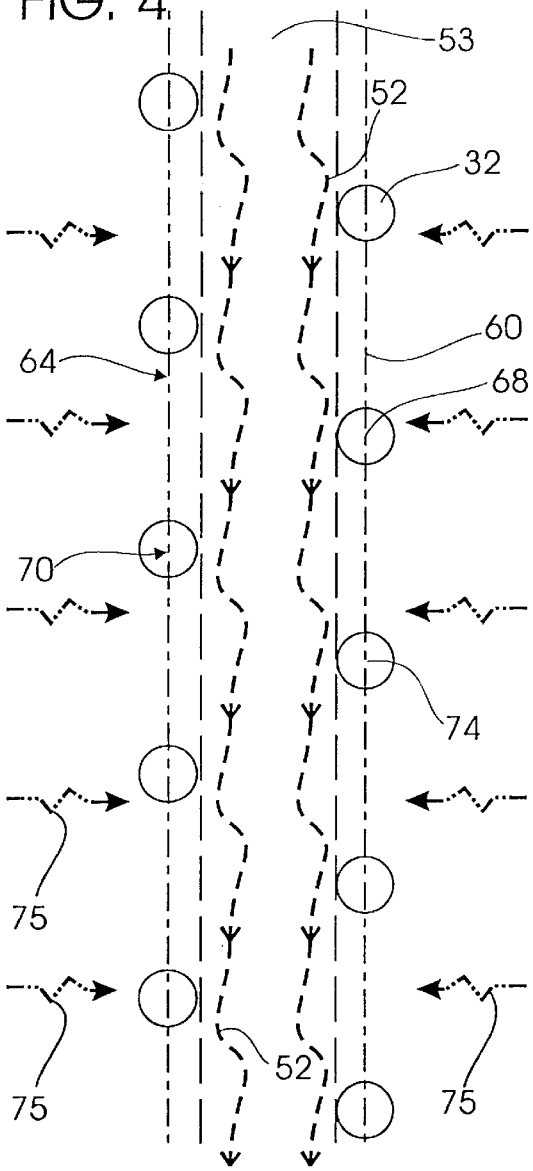
FIG. 4 is an illustration showing radiant and convective heat influences associated with the invention's preferred embodiment.

Turning now to FIG. 3. FIG. 3 first depicts the heated flue gas 48 rising within the second heating section 20 and entering the first heating section 4. Of greater significance however, is the channeled return of cooling flue gas 52 as it contained within the interior portion of the double row heating conduit 32. Consequently, the cooling flue gas 52 as it descends within the double row heating conduit 32, provides and introduces convective heat to the interior portion of the double row heating conduit 53. FIG. 4 provides a more detailed view of the interior channel portion 53 of the double row heating conduit 32 and, the path of travel of cooling flue gas 52 as it progresses in a downward direction within said channel 53 toward the base of the coker heater 44. Turning now to FIG. 4.

As can be seen in FIG. 4, the cooling flue gas 52 descends through the channel 53 created by the left most interior boundary 64 and right most interior boundary 60 of the double row heating conduit 32. FIG. 4 also illustrates triangular spacing of the contiguous tubular row comprising the double row heating conduit 32. Though the double row heating conduit 32 allows for flexibility in design, triangular boundaries represented by a leftmost channel boundary point 70 and an immediately adjacent rightmost channel boundary point 68 or 74 should generally fall between 2.5 D and 3.5 D, where "D" is equal to the nominal diameter of the tubing used for the double-row heating conduit 32. Vertical spacing between any two vertically adjacent points in either the left most channel 64 and right most channel 60 falls subject to the same measurement constraints. An illustrative example of such spacing characteristics is provided by right-most channel boundary points 68 and 74. Radiant heat direction within the radiant heat section of the coker conduit is illustrated via directional arrows 75. For illustrative purposes, FIG. 4 presents an end view perspective of the double row heating conduit 32, while FIG. 5 provides a more detailed view of the ladder like structure supporting the double row heating conduit 32.

Figure 5:
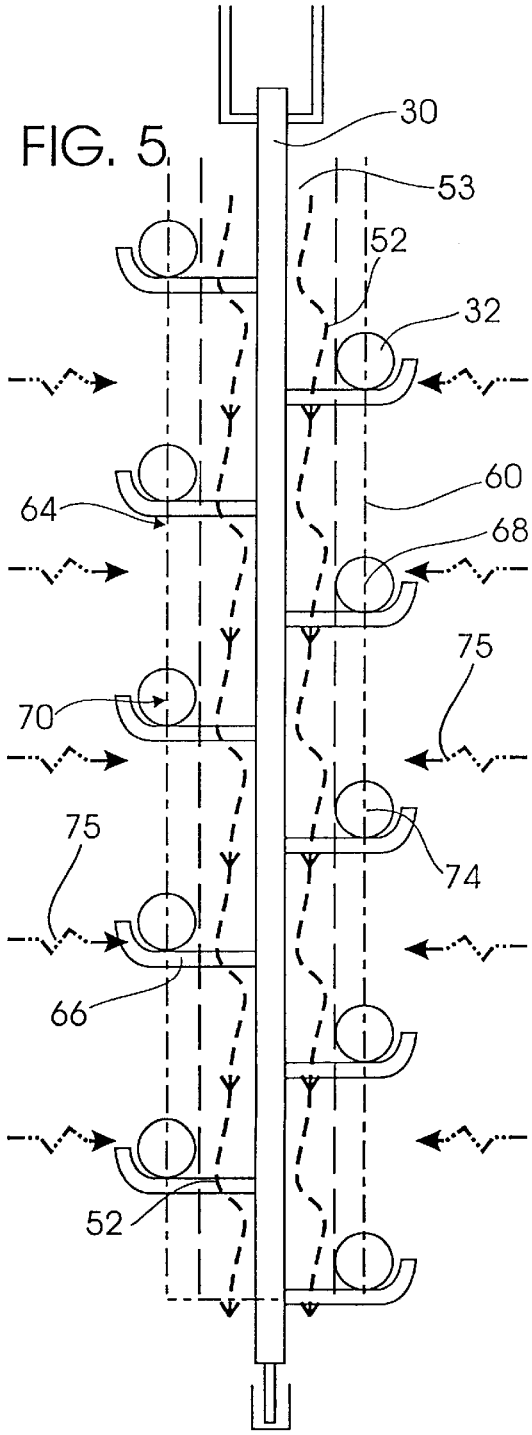
FIG. 5 is an illustration providing closer detail of the invention's double row heating conduit support structure.

FIG. 5 illustrates the invention's double row heating conduit support structure 30. In the invention's preferred embodiment, a double row heating conduit support structure 30 would be placed at 13 foot intervals to support a 60 foot length double row heating conduit, allowing for a 4 foot overhang on each end to accommodate the serpentine coil configuration of the conduit 32. Consequently, said 60 foot double row heating conduit section would require five support structures. Support structures 30 for longer or shorter length heating conduits 32 would be positioned and spaced proportionate to spacing disclosed for 60 foot double row heating conduit 32 lengths. Support structures 30 may be affixed to either the top or bottom of the second heating section 20, with the non-affixed end of said support structures 30 movably positioned within guides attached to the top or bottom of said second heating section 20. Such affixation/moveable positioning intended to accommodate heat expansion of said support structures 30.

While this invention has been described to illustrative embodiments, this description is not to be construed in a limiting sense. Various modifications and combinations of the illustrative embodiments as well as other embodiments will be apparent to those skilled in the art upon referencing this disclosure. It is therefore intended that this disclosure encompass any such modifications or embodiments.

What is claimed is:

1. A delayed coking charge heater for heating a coker feedstock comprising:

a first heating section providing convective heat to said coker feedstock;

a second heating section adjacent to said first heating section, said second heating section providing both convective and radiant heat to said coker feedstock;

a horizontally positioned double row heating conduit positioned centrally between and spaced apart from opposite sidewalls of said second heating section;

a double row heating conduit support structure positioned to support said double row heating conduit; and a plurality of burners located within said second heating section.

2. A heater according to claim 1 wherein said plurality of burners are located generally in an upper portion of said second heating section, said burners positioned on the outward and opposite sides of said conduit so as to be capable of directing flames upwardly within said second heating section along a plane generally parallel to said opposite sides of said horizontally positioned double row heating conduit.

3. A heater according to claim 1 wherein said plurality of burners are located generally along the sidewalls of said second heating section, said burners positioned so as to be capable of providing and directing flames toward the interior portion of said conduit.

4. A heater according to claim 1 wherein said plurality of burners are located generally along the end walls of said second heating section, said burners positioned so as to be capable of providing and directing flames horizontally and along said opposite sides of said conduit.

5. A heater according to claim 1 wherein said support structure further comprises a plurality of double row conduit support structures, said structures affixed to the generally upper most horizontal portion of said second heating section and movably positioned within guides attached the generally lower most portion of said second heating section.

6. A heater according to claim 1 wherein said support structure further comprises a plurality of double row conduit support structures, said structures affixed to the generally lower most horizontal portion of said second heating section and movably positioned within guides attached to the generally upper most portion of said second heating section.

7. A heater according to claim 1 wherein said double row heating conduit is of tubular construction, said tubular construction comprising a generally horizontal and reciprocating path of continuous tubing extending from an inlet in the upper portion of said heating section downwardly to an outlet located in the lower portion of said second heating section.

8. A heater according to claim 7 wherein a plurality of portions of said double row heating conduit are generally represented as a serpentine coil.

9. A heater according to claim 8 wherein said coiled portions of said heating conduit are spaced apart from the adjacent coiled portions thereof.

10. A heater according to claim 1 wherein said double row heating conduit is of tubular construction, said tubular construction comprising a plurality of generally horizontal and reciprocating paths of continuous tubing extending from inlets in the upper portion of said heating section downwardly to a plurality of outlets located in the lower portion of said second heating section.

11. A heater according to claim 10 wherein said plurality of generally horizontal and reciprocating paths of continuous tubing are generally represented as serpentine coils.

12. A heater according to claim 11 wherein said coiled portions of said generally horizontal and reciprocating paths of continuous tubing heating conduit are spaced apart from the immediately adjacent coiled portions thereof.

13. A heater according to claim 1 wherein said burners are located within generally in a lower portion of said second heating section, and positioned on the outward and opposite sides of said conduit so as to be capable of directing flames upwardly within said second heating section along a plane generally parallel to said opposite sides of said horizontally positioned double row heating conduit.

* * * * *